United States Patent [19]

Jansen

[11] Patent Number: 4,843,744

[45] Date of Patent: Jul. 4, 1989

[54] SNOWPLOW

[75] Inventor: Johann Jansen, Holten, Netherlands

[73] Assignee: Ing. Alfred Schmidt GmbH, Blasien, Fed. Rep. of Germany

[21] Appl. No.: 114,682

[22] Filed: Oct. 29, 1987

[30] Foreign Application Priority Data

Dec. 16, 1986 [DE] Fed. Rep. of Germany ..... 3642888

[51] Int. Cl.[4] ..... E01H 5/06

[52] U.S. Cl. ..... 37/232; 37/231

[58] Field of Search ..... 37/232, 233, 231

[56] References Cited

U.S. PATENT DOCUMENTS

| | | | |
|---|---|---|---|
| 2,290,060 | 7/1942 | Massey | 37/232 X |
| 2,877,573 | 3/1959 | Kewyon | 37/232 |
| 2,991,566 | 7/1961 | Sumner et al. | 37/232 |
| 3,587,182 | 6/1971 | Hirt | 37/232 |
| 3,772,803 | 11/1973 | Cote | 37/233 |
| 4,074,448 | 2/1978 | Niemela | 37/232 X |

*Primary Examiner*—Edgar S. Burr
*Assistant Examiner*—James Lisehora
*Attorney, Agent, or Firm*—Helfgott & Karas

[57] ABSTRACT

A snowplow whose blade is joined means of at least two links disposed one over the other to an implement plate which can be fastened to a vehicle plate of a working vehicle has a system which assures the proper operation of the blade even when it passes over obstacles. This system permits an upper and lower link to be raised over obstacles and to tilt the links due to the fact that the upper link or links are made so as to be able to elongate against the action of a spring force.

3 Claims, 2 Drawing Sheets

SNOWPLOW

BACKGROUND OF THE INVENTION

The invention relates to a snowplow whose blade is joined by two links disposed one above the other to a mounting which can be fastened to a vehicle plate of a work vehicle, and has a mechanism which permits the blade to trip when driven over obstacles.

In known, so-called multiple blade spring plows (German Federal Pat. No. 17 08 664) the individual blade segments are fastened to a supporting frame, the latter being rotatable about a horizontally disposed plow tube, and both parts are fixed in a particular rotational attitude toward one another. If the spring travel of a particular blade segment is exceeded upon running over an obstacle (the links on which each blade segment is suspended have thus reached their end position) the particular blade segment can be turned around the plow tube after the shear pin is severed, in which case the cutting edge yields rearwardly and upwardly.

In another known plow blade consisting of segments (German Auslegeschrift No. 1 278 465) the individual blade elements are fastened by upper and lower rubber bands to a supporting frame. When an obstacle is encountered the rubber bands deform and permit the blade segment to trip upwardly.

SUMMARY OF THE INVENTION

It is an object of the present invention to provide an improved snowplow which offers, in a link between a plow blade and a support, an additional possibility for the tripping of the snowplow blade which will act independently of the design of the support of the plow blade.

According to the present invention the upper link or links are extendable against the action of a spring force.

This proposal on the one hand assures a rigid connection between the blade and support in the sense that the plow blade can be forced against the ground when plowing; on the other hand, upon running over obstructions projecting above the surface of the ground, the plow blade can be tripped without danger of damage by tilting forward against the action of the spring force, while the upper link or links are lengthened.

The support on which the plow blade is suspended can, in the case of a simple snowplow design, be the implement plate that is to be fastened to the mounting plate on the vehicle; in the case of snowplows of the multiple blade spring type, the support is formed by a frame; this frame is joined to the implement plate by a hydraulically supported additional link coupling having rigid links.

For special plowing tasks, namely for heavy clearing of a hard-packed snow covering, the elongation of the upper link or links can be prevented simply by an appropriate locking means. For the avoidance of damage to the snowplow it is desirable to provide a shear pin as the locking means.

In the scope of the invention the plow blade can be made rigid in itself; if can, however, also be provided with cutting edges fastened to spring flaps.

Embodiments of the invention will now be explained in conjunction with the drawing.

DETAILED DESCRIPTION OF THE PREFERRED EMBODIMENT

Figure 1:
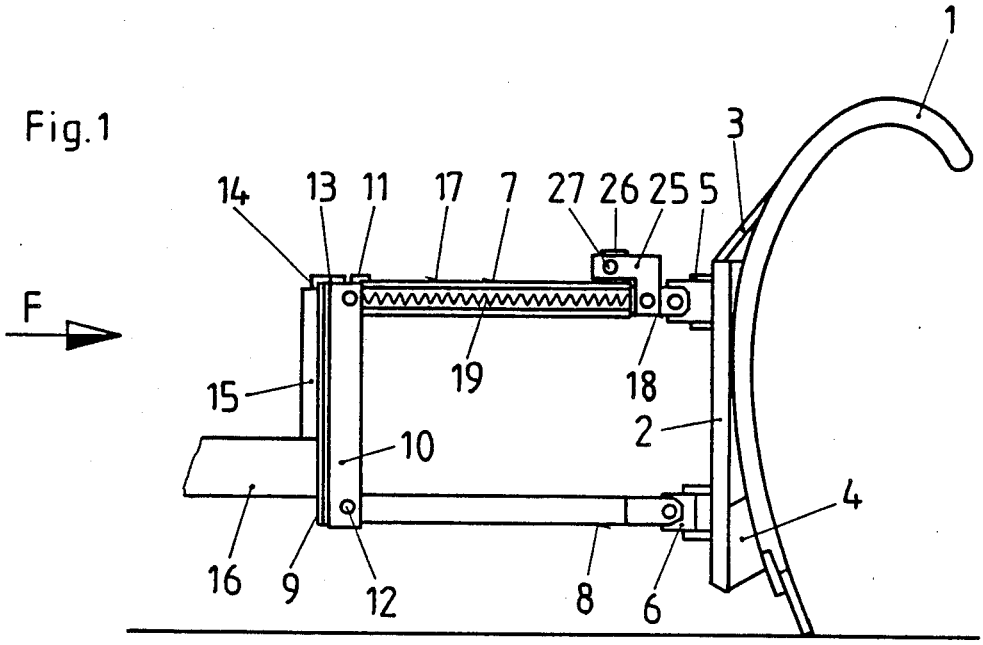
FIG. 1 is a side view of the snowplow.

According to FIG. 1, a plow blade 1 is fastened to a back plate 2 by means of an upper bar 3 and a lower bar 4. On the side of the back plate facing away from the plow blade there is provided an upper swivel 5 and a bottom swivel 6. An upper link 7 and a lower link 8 are provided at the swivels 5 and 6, being attached to the latter each at one end. The opposite ends of the links are fastened to an implement plate 9 and they also pivot about horizontal axes. The implement plate 9 has for this purpose vertical angle irons 10 on opposite sides, between whose forward pointing flanges crossmembers 11, which are also angle irons, are mounted for pivoting about horizontal axes 12. The implement plate 9 has on its upper edge a horizontal crossrail 13 which has downwardly pointing hook portions 14 engaging pockets, not shown, in a vehicle plate 15 joined to the working vehicle. The vehicle plate is joined by means of a beam 16 to the working vehicle which is not shown.

While the bottom link 8 is made in one piece and is stiff, the upper link 7 is composed of two telescopiing hollow members, an outer link member 17 being articulated indirectly to the implement plate 9, while an inner link member 18 is articulated indirectly to the plow blade. The two link members 17 and 18 are joined together by means of a tension spring 19 stretched in their interior.

Figure 3:
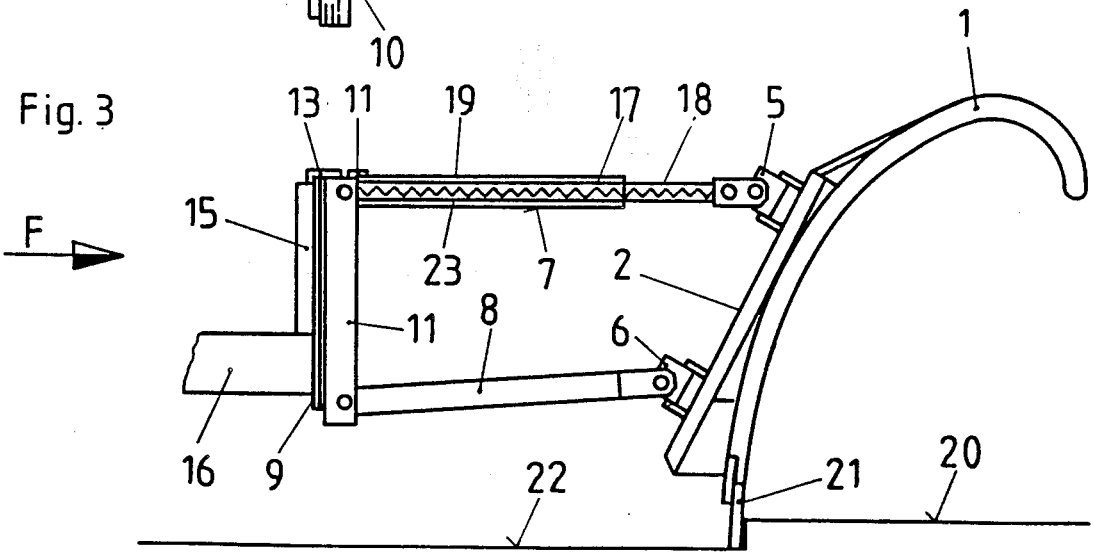
FIG. 3 is a side view of the plow in an inclined position over an obstruction.

In FIG. 3, the plow blade 1 is represented in a position in which it has tripped over an obstacle 20, the cutting edge 21 of the blade 1 being still in front of the obstacle and resting with its bottom edge on the ground surface 22. Both of the links 7 and 8 are sloping slightly upward toward the plow blade; the upper link 7 is elongated to accommodate the slant of the blade. It can be seen from the position of the inner end 23 of the inner link member 18 of the upper link 7 that the inner link member 18 can still emerge further out of the outer link member 17, so that, as the snowplow advances in the plowing direction indicated by the arrow F, the obstacle (20) can be passed over completely while the plow blade 1 will tilt still further forward.

Figure 2:
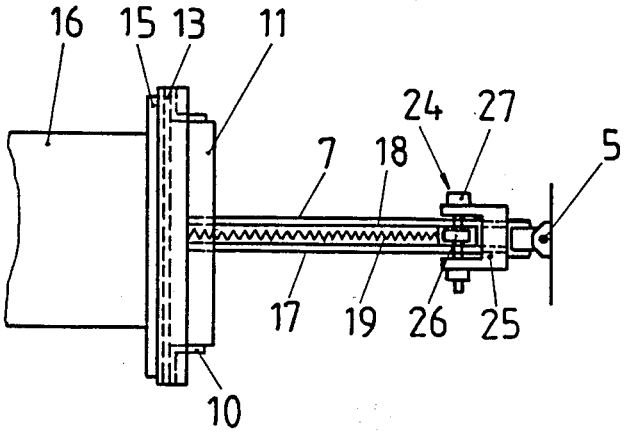
FIG. 2 is a top view of the snowplow blade hitch.

A locking device 24 is additionally shown in FIGS. 1 and 2. This consists of a shackle 25 on the inner link member 18 of the upper link and an upwardly reaching tongue 26 which is fastened to the outer link member 17 and extends into the gap in the shackle. By means of a shear pin 27 passed through bores in the shackle 25 and in the tongue the outer link member 17 and the inner link member 18 of the upper link can be joined together in a rigid manner so as to be unable to elongate. This junction is unlocked when the snowplow is used normally, i.e., the shear pin is used only under special plowing conditions, e.g., when plowing hardpacked snow whose removal requires the plow blade 1 to be pressed against the ground surface 22.

Figure 4:
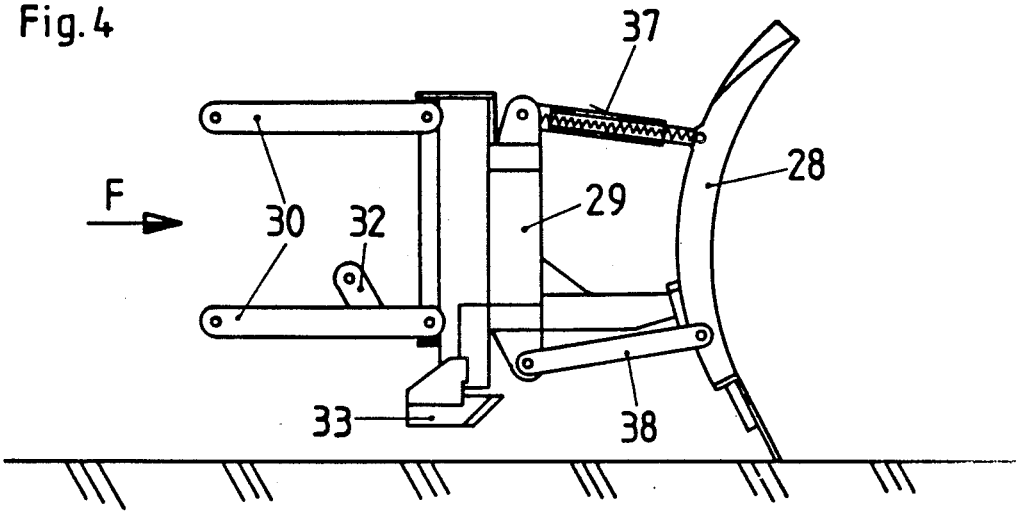
FIG. 4 is a side view of a multiple-blade spring plow in the normal position.
Figure 5:
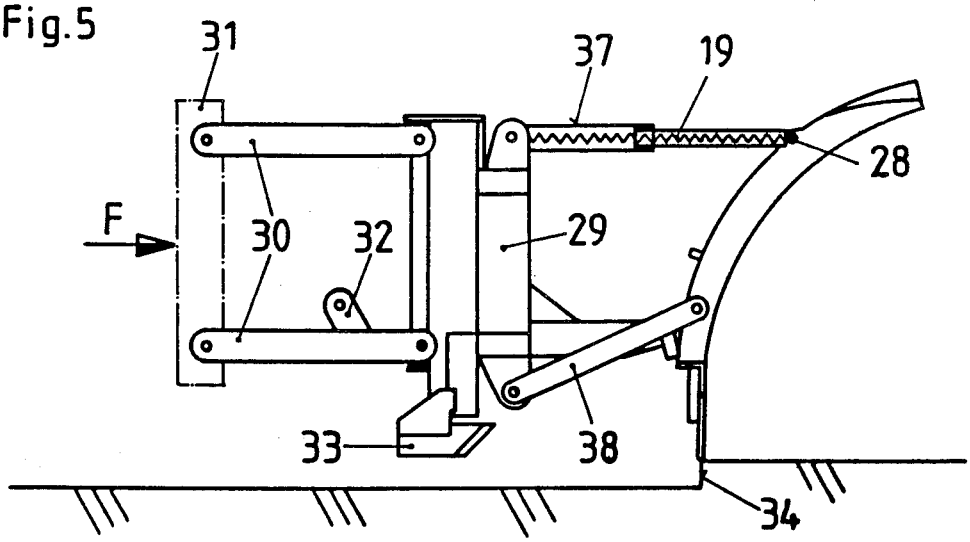
FIG. 5 shows the multiple-blade spring plow of FIG. 4 in the tripped position.

FIGS. 4 and 5 show the telescoping upper link 37 in the example of a multiple blade spring plow. Here the individual plow segments 28 are linked by the telescoping upper links 37 and the stiff bottom links 38 to a supporting frame 29 which is fastened by a control link system 30 to the implement plate 31 so as to be able to be raised and lowered. Usually one or two upper and lower links are provided for each plow blade segment. The vertical raising and lowering are performed by means of a hydraulic jack which is not shown and which is articulated at one end to a tongue 32 of the control link system and at the other end to the implement plate 31. At the bottom of the supporting frame there is provided a skid 33 which limits any undesired downward deflection of the control link system 30. According to FIG. 5, the blade segment 28 has just passed over a threshold 34. This is substantially facilitated by the fact that the upper link 37 elongates telescopically from its shortened normal state represented in FIG. 4, with a corresponding elongation of the tension spring 19.

I claim:

1. Snowplow comprising a plough blade, a plurality of links which solely join said blade to a mounting which can be fastened to a vehicle plate of a working vehicle, at least two of said links being disposed one over another, an upper link of said two links being formed so as to be able to elongate against an action of a spring, and means permitting the plough blade during travelling to perform a tripping movement over obstacles so that the plough blade tilts with respect to a point of contact with the obstacle when travelling against the latter, the upper link elongates and a lower link becomes inclined during the tilting movement of said plough blade such that an end thereof connected to the plough blade lies on a higher level than its end connected to the mounting, whereby the plough blade is lifted by the lower link when the working vehicle is further moved forward, said upper link being telescopically extendable and said lower link being stiff, said upper link including two telescopic hollow members, said spring being a tension spring disposed inside said upper link and pulling two hollow members thereof together.

2. Snowplow according to claim 1, further including locking means for locking together said two telescopic hollow members when the hollow members are in a non-extended position.

3. Snowplow according to claim 2, wherein said locking means includes a shackle mounted on one of said hollow members and a shear pin passing through said shackle and another of said hollow members to rigidly connect said hollow members to each other.

* * * * *